US005319869A

United States Patent [19]

McDonald et al.

[11] Patent Number: 5,319,869

[45] Date of Patent: Jun. 14, 1994

[54] ATHLETIC SHOE INCLUDING A HEEL STRAP

[75] Inventors: Steven C. McDonald, Portland; Allen W. Van Noy, Beaverton, both of Oreg.

[73] Assignee: Nike, Inc., Beaverton, Oreg.

[21] Appl. No.: 806,292

[22] Filed: Dec. 13, 1991

[51] Int. Cl.[5] ..... A43B 5/00; A43B 11/00

[52] U.S. Cl. ..... 36/114; 36/50.1; 36/58.5; 36/92

[58] Field of Search ..... 36/50.1, 68, 69, 89, 36/92, 114, 58.5

[56] References Cited

U.S. PATENT DOCUMENTS

| | | | |
|---|---|---|---|
| D. 301,799 | 6/1989 | Tonkel | D2/264 |
| 752,172 | 2/1904 | Manss | 36/50 |
| 1,668,120 | 10/1927 | McLaren | 36/50 |
| 1,683,465 | 10/1926 | Hill | 36/50 |
| 1,788,275 | 1/1928 | Bullock | 36/50 |
| 1,861,299 | 4/1930 | Bullock | 36/50 |
| 1,863,592 | 3/1931 | Dawes | 36/50 |
| 2,147,197 | 11/1936 | Glidden | 36/45 X |
| 2,356,490 | 1/1943 | Crotty | 36/9 R |
| 2,994,972 | 6/1960 | Blair | 36/92 |
| 3,193,950 | 3/1963 | Liou | 36/50 |
| 3,213,551 | 10/1965 | Krauss | 36/102 |
| 3,327,410 | 6/1967 | Park, Sr. et al. | 36/89 |
| 3,408,752 | 11/1968 | Lollmann | 36/105 |
| 4,107,857 | 8/1978 | Devlin | 36/129 |
| 4,245,408 | 1/1981 | Larsen et al. | 36/50 |
| 4,282,657 | 8/1981 | Antonious | 36/50 |
| 4,282,659 | 8/1981 | Bourque et al. | 36/121 |
| 4,366,631 | 1/1983 | Larsen et al. | 36/50 |
| 4,510,701 | 4/1985 | Schour et al. | 36/68 |
| 4,547,983 | 10/1985 | Brandt | 36/131 |
| 4,571,856 | 2/1986 | Lin et al. | 36/89 |
| 4,577,419 | 3/1986 | Chassaing | 36/114 X |
| 4,622,764 | 11/1986 | Boulier | 36/69 X |
| 4,649,939 | 3/1987 | Curtis | 128/80 H |
| 4,670,998 | 6/1987 | Pasternak | 36/114 |
| 4,811,500 | 3/1989 | Maccano | 36/91 |
| 4,811,502 | 3/1989 | Barrett | 36/117 |
| 4,817,303 | 4/1989 | Selbiger | 36/50 |
| 4,856,209 | 8/1989 | Kenyon | 36/114 |
| 4,922,630 | 5/1990 | Robinson | 36/89 |
| 4,942,678 | 7/1990 | Gumbert | 36/102 |
| 4,947,560 | 8/1990 | Fuerst et al. | 36/88 |
| 4,967,750 | 11/1990 | Cherniak | 36/11.5 X |
| 4,972,609 | 11/1990 | Oh et al. | 36/50 X |
| 4,972,613 | 11/1990 | Loveder | 36/50 X |
| 4,989,350 | 2/1991 | Bunch et al. | 36/89 |
| 5,086,576 | 2/1992 | Lamson | 36/3 R X |
| 5,109,613 | 5/1992 | Van Dyke | 36/114 X |

*Primary Examiner*—Paul T. Sewell
*Assistant Examiner*—BethAnne Cicconi
*Attorney, Agent, or Firm*—Banner, Birch, McKie & Beckett

[57] ABSTRACT

The present invention is directed to an athletic shoe including a heel strap for securing the foot in the shoe. The shoe includes an upper and a sole. The upper includes a quarter and a relatively stiff counter disposed at the periphery of the shoe. The quarter includes a lacing eyestay having a plurality of lacing eyelets. The counter has an opening formed through each side thereof and located such that when the shoe is worn on a foot, the openings are disposed below the malleolus. The upper also includes a relatively thin, flexible inner sleeve disposed interiorly of the quarter and counter. The shoe includes a heel strap having a heel tab fixed to the rear of the inner sleeve, and side straps extending laterally forwardly on both sides of the shoe. Side tabs including one or more eyelets are disposed on the forward end of each of the side straps. The side straps are disposed through the openings formed in the counter and are bent upwardly exterior of the counter, with the side tabs disposed adjacent the uppermost lacing eyelet. In securing the shoe, the shoe lace may be disposed through both the eyelets of the side tabs, and the corresponding eyelet of the upper on each side so as to adjustably secure the heel strap against the foot.

16 Claims, 6 Drawing Sheets

ATHLETIC SHOE INCLUDING A HEEL STRAP

BACKGROUND OF THE INVENTION

1. Field of Invention

The present invention is directed to an athletic shoe, and in particular, an athletic shoe including an adjustable heel strap for securing the foot in the shoe.

2. Description of the Prior Art

Athletic shoes including heel strap systems are known in the art. U.S. Pat. No. 1,668,120 to McLaren discloses a shoe including a strip or strap disposed between the quarter and lining of a shoe. The generally thin strap is fixed at the back, and extends forwardly about the upper perimeter or collar of the quarter, at the location of the foot opening. The forward end of the strap includes an eyelet through which the shoe lace may be disposed. U.S. Pat. No. 1,683,465 to Hill discloses a similar shoe in which the strap is disposed exteriorly of the shoe upper, and is laced through a plurality of slots formed in the exterior surface of the upper.

In both Hill and McLaren, the overall effect provided by the strap is to pull the posterior aspect of the collar forwardly, and thereby secure the top of the upper about the foot. The posterior aspect of the collar is not pulled substantially downwardly towards the midsole. Further, in Hill the strap acts on the foot through a relatively thick upper. Thus, the effectiveness of the strap is diminished due to the fact that the strap cannot effectively conform to the shape of an individual foot, and must act on the foot through an intermediary element which is relatively thick or stiff. A similar drawback is present in McLaren, in which the strap acts through a lining, and the ability of the strap to conform to the foot is diminished due to the fact that any inward movement of the strap is limited by the stiffness of the quarter.

U.S. Pat. Nos. 4,245,408 and 4,366,631 to Larsen et al. disclose a shoe having a second lace which is distinct from the main lace of the shoe. The second lace is disposed about the rear of the shoe and tied at the top of the lacebox, above the location where the main shoe lace is tied. The second lace is disposed externally of the shoe upper, through eyelets fixed to the rear and sides of the upper. As with McLaren and Hill, the lace does not conform substantially to the shape of the foot, and must act through relatively thick and rigid intermediary components.

SUMMARY OF THE INVENTION

The present invention is directed to a shoe including a sole and an upper extending from the sole. The upper includes an opening disposed therethrough on each side, with the openings located so as to be positioned below the malleoli when the shoe is worn. A heel strap extends about a rear portion of the wearer's heel, and has forward ends. The heel strap is disposed downwardly and forwardly on both sides of the shoe towards and through the openings, and upwardly forward from the locations of the openings. The heel strap is secured at its forward ends adjacent to the upper.

In a further embodiment, the shoe includes a shoe lace, and the upper includes a plurality of lacing eyelets. The heel strap has one or more eyelets disposed through each forward end, and the eyelets of the heel strap are disposed adjacent a corresponding lacing eyelet on each side of the shoe such that each end of the lace of the shoe may be disposed through one of the heel strap eyelets and a corresponding lacing eyelet.

In a further embodiment the upper includes a counter and an inner sleeve disposed interiorly of the counter. The openings in the upper are disposed through the counter. The heel strap is disposed adjacent the inner sleeve at the heel and extends laterally forwardly on both sides of the inner sleeve towards the openings.

In a further embodiment, the heel strap includes a heel tab attached at one end to the inner sleeve. At the other end, the heel tab may be either attached to the counter or free standing from the counter.

The present invention provides the advantage that the heel strap acts on the foot only through a thin sleeve, and thus closely conforms to the shape of an individual foot. Further, the pull of the heel strap is generally forward and downward on the heel of the foot from the location of the openings below the malleoli, securely binding the heel in relation to the shoe, in particular, securely seating the rearfoot in the midsole. The heel strap is disposed as to avoid interfering with plantar and dorsi flexion of the wearer's foot. Further, the pull of the heel strap is generally rearward, downward and about the dorsal aspect of the midfoot from the location of the openings below the malleoli, securely binding the midfoot to the sole.

DETAILED DESCRIPTION OF THE PREFERRED EMBODIMENTS

Figure 1:
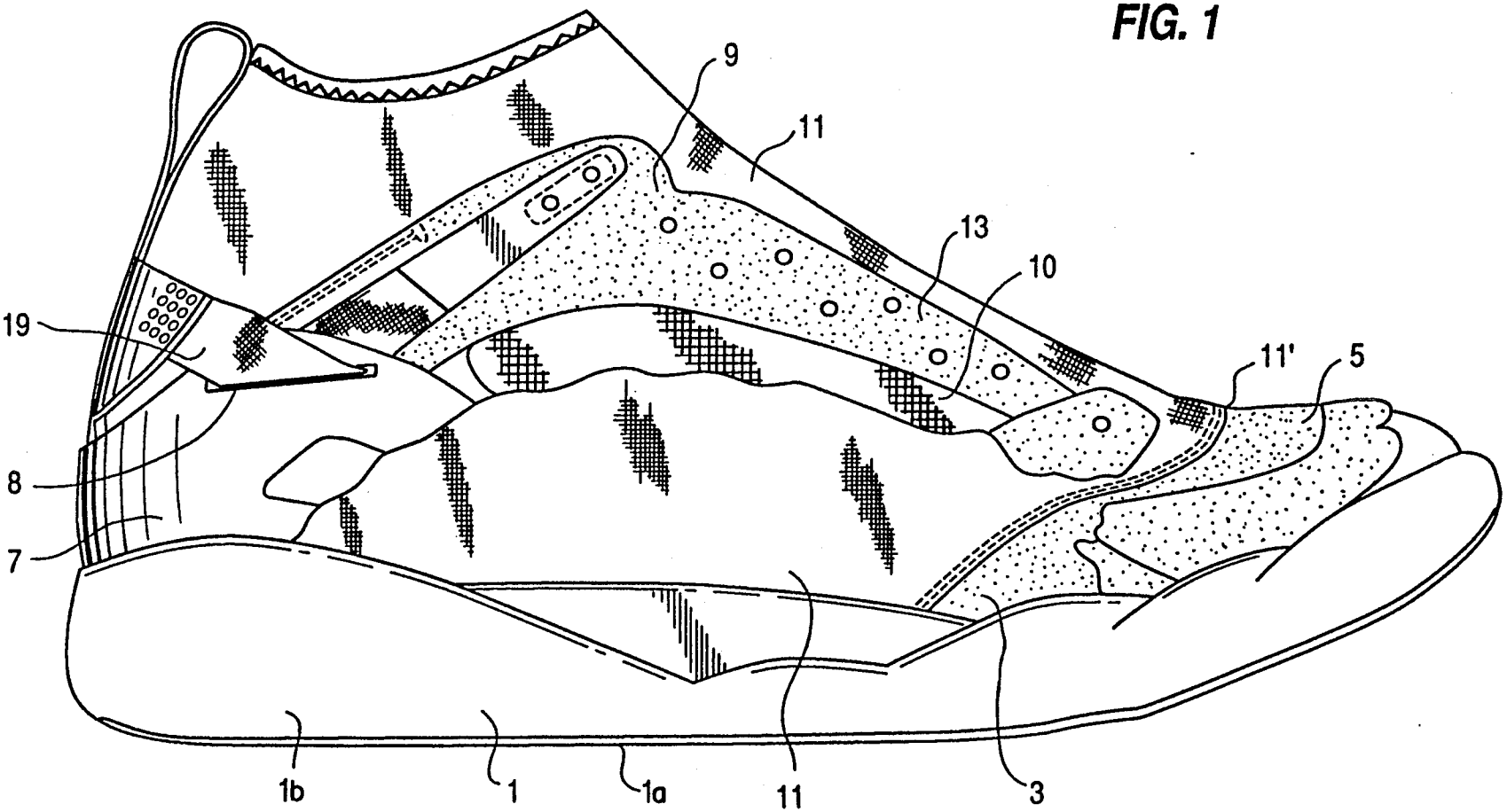
FIG. 1 shows a partially broken away side view of an athletic shoe according to the present invention.
Figure 2A:
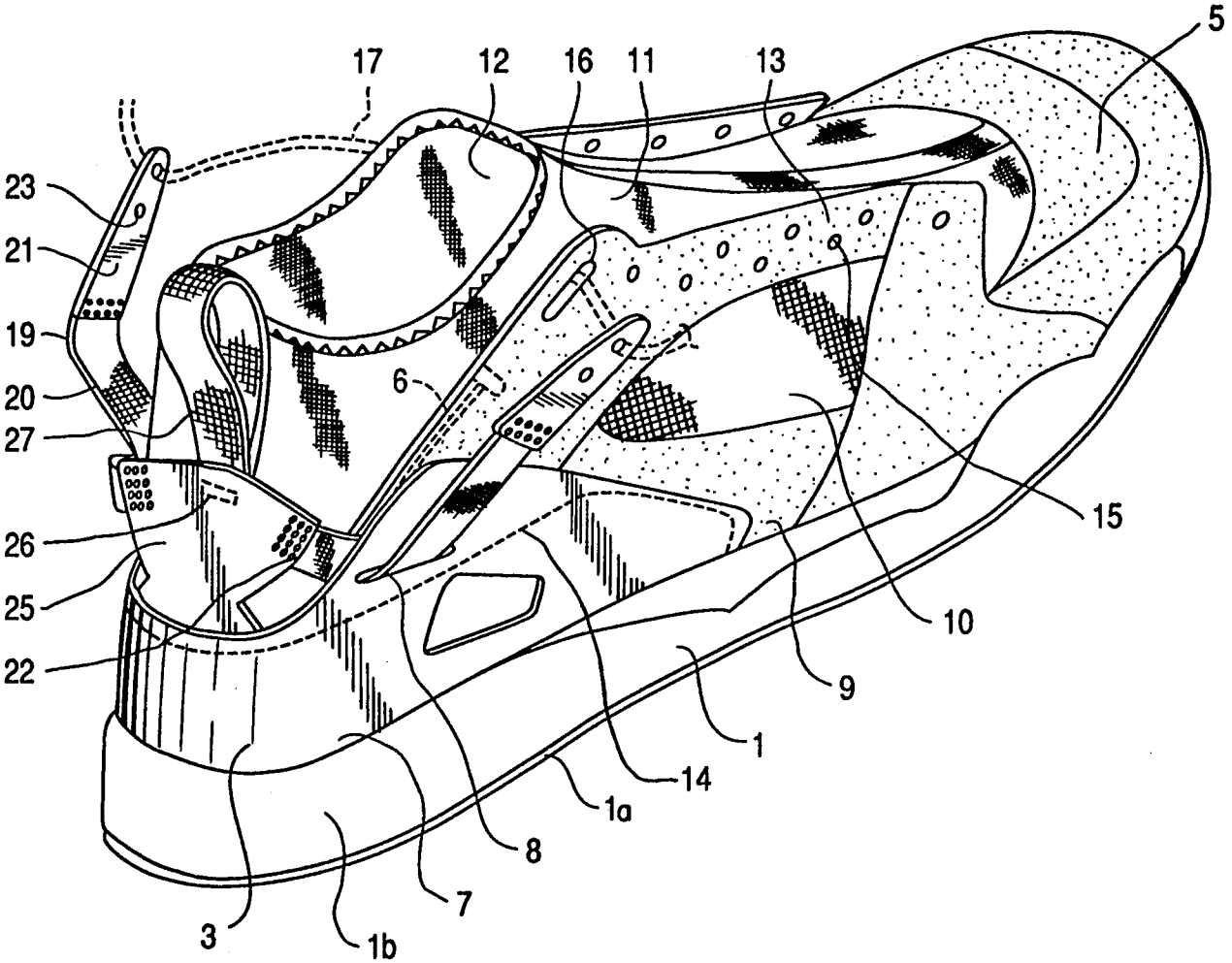
FIG. 2*a* shows a rear perspective view of an athletic shoe according to a first embodiment of the present invention.

With reference to FIGS. 1 and 2*a*, an athletic shoe according to the present invention is shown. The athletic shoe includes a conventional sole 1, which may further include conventional outsole 1*a* and conventional midsole 1*b*. Upper 3 is secured to the upper surface of sole 1 and includes vamp 5 and quarter 9 made of a conventional material, for example suede. Quarter 9 includes eyestay 13 defining the upper boundary thereof on both sides of the shoe. A plurality of conventional eyelets 15 are disposed through opposite sides of eyestay 13. The shoe may be secured in a conventional manner by lace 17 disposed through eyelets 15. The upper and rearmost eyelet 16 has an elongated, essentially oval shape, and is inclined rearwardly and downwardly from the top of the eyestay towards the rear of the shoe. The length of eyelet 16 may be, for example, approximately ¾". Quarter 9 may also include web or netting portion 10.

Upper 3 further includes counter 7 made of a relatively stiff or rigid material, for example, leather or plastic. Counter 7 extends around the heel area of the foot, and generally forwardly of the calcaneus on both sides of the foot. Alternatively, counter 7 can extend on the medial and lateral sides of the calcaneus, but not substantially about the posterior aspect of the heel of the foot. The rear portion of quarter 9 is disposed interiorly of counter 7, and counter 7 may be secured to quarter 9 by, for example, stitching, along stitch line 14 such that the portion of counter 7 located above the stitch line may be flexed outwardly relative to quarter 9. Alternatively, counter 7 could be located interiorly of quarter 9. Counter 7 provides increased rearfoot stability and control.

Both counter 7 and quarter 9 are secured to the top of midsole 1*b* of sole 1 about the periphery thereof by conventional means, for example, by cement and/or stitching. Alternatively, counter 7 and/or shoe quarter 9 could be secured about, or within midsole 1*a* of sole 1. Openings 8 are formed through an upper region of counter 7 on both the medial and lateral sides thereof, above stitch line 14. Openings 8 extend substantially horizontally and have a length of about one inch. With reference to the bones of a foot, when the shoe is worn, openings 8 generally are disposed at a position below the location of the malleoli, that is, the rounded medial and lateral protruberances of the tibia and fibula bones of the leg about the ankle joint, in such a manner as to not substantially interfere with the axis of rotation associated with dorsi and plantar flexion of the foot.

Upper 3 further includes inner sleeve 11 disposed interiorly of both quarter 9 and counter 3. Doubled-dashed line 11′ defines the forward border of sleeve 11, and extends from the rear of vamp 5 laterally downwardly along a curved path to the top of midsole 1*b* of sole 1, at a location adjacent the metatarsals. At its forward end, sleeve 11 is secured to the rearward border of vamp 5. Rearward of the intersection of line 11′ with midsole 1*b*, sleeve 11 extends substantially downwardly to the top of midsole 1*b*, and is secured to the top of midsole 1*b* about the periphery, along with counter 7 and quarter 9, as discussed above. Sleeve 11 may be secured to the various elements by conventional means, such as stitching.

Above the location of the intersection of sleeve 11 with sole 1, and rearward of vamp 5, sleeve 11 may be secured to quarter 9 at a location below the upper border of the quarter. For example, sleeve 11 may be stitched to quarter 9 below netting or mesh 10. Sleeve 11 is also secured to counter 9 at stitch line 6. Therefore, quarter 9 may be flexed outwardly relative to sleeve 11 above the locations where it is fixed to counter 9. Sleeve 11 includes foot opening 12 disposed above both counter 7 and quarter 9. Thus, sleeve 11 virtually envelopes the upper and side surfaces of the foot and the ankle. Sleeve 11 eliminates the need for a tongue, and eyestay 13 overlaps sleeve 11 when the shoe is secured on the foot. Sleeve 11 is made of a relatively thin, flexible material such as neoprene which fits snugly about the foot. Sleeve 11 is freely flexible within upper 3, above the various stitch lines.

Figure 2B:
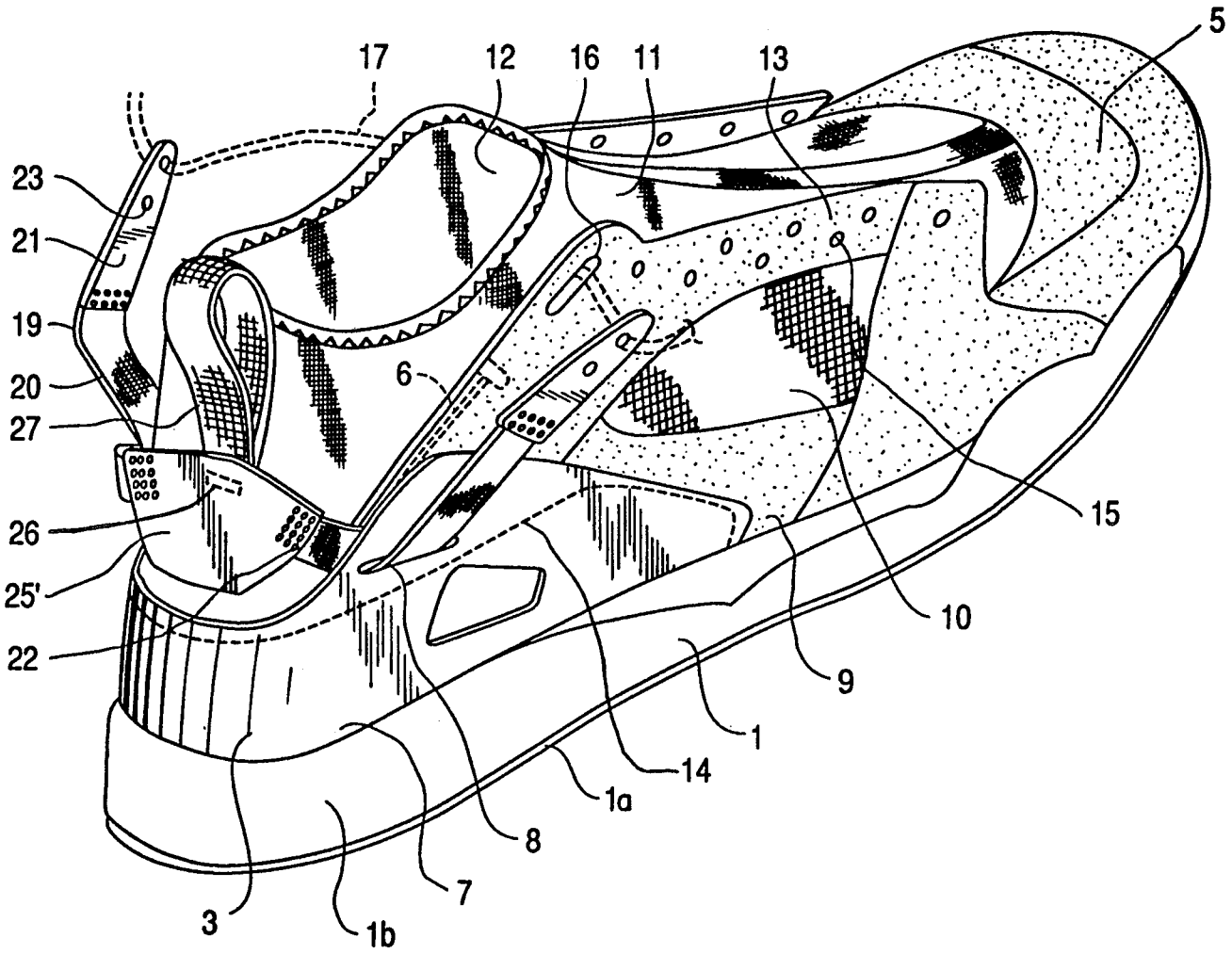
FIG. 2*b* shows a rear perspective view of an athletic shoe according to a second embodiment of the present invention.
Figure 2C:
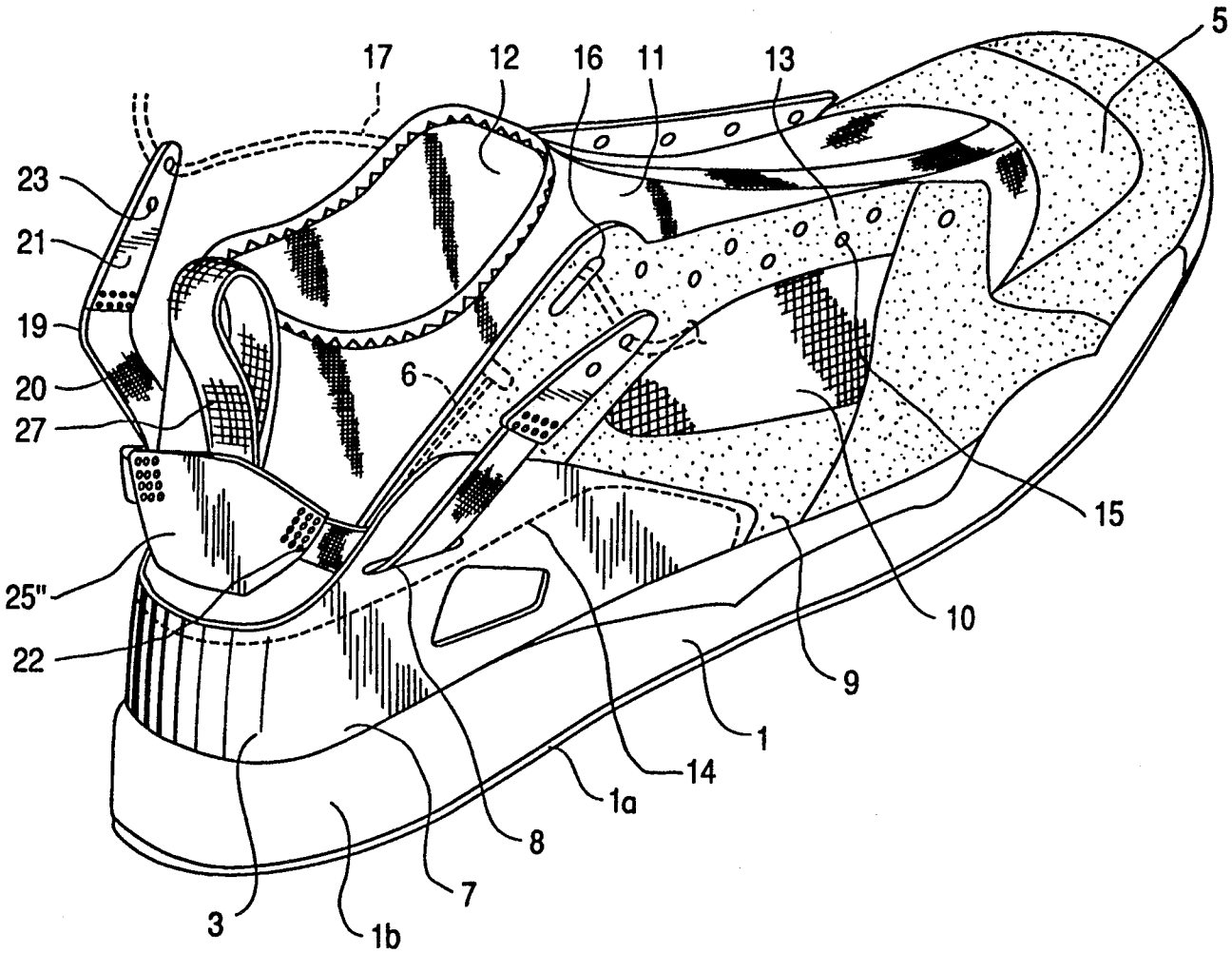
FIG. 2*c* shows a rear perspective view of an athletic shoe according to a third embodiment of the present invention.

As shown in FIG. 2*a*, heel strap 19 includes side portions 20, heel tab 25 and side tabs 21. Heel tab 25 is made of a flexible plastic material such as HYTREL®. Heel tab 25 is secured at its base to counter 7, and is secured to sleeve 11 near the top edge, for example, by stitching 26. In between the base and the top edge, heel tab 25 is substantially free of both sleeve 11 and counter 7. As shown in FIG. 2*b*, heel tab 25′ need not be secured to counter 7, and would thus be completely free-standing therefrom. As shown in FIG. 2*c*, heel tab 25″ need not be secured to either counter 7 or sleeve 11, and would thus be completely free-standing from both, or floating.

Side portions 20 are made of a flexible material such as nylon, and extend laterally forwardly from heel tab 25 about the foot on both sides. Side portions 20 are about ¾ of an inch wide, and are joined to heel tab 25 at joint 22. Side portions 20 are not joined to either counter 7 or quarter 9. The location of joint 22 is higher than the location of openings 8. Side tabs 21 are disposed at the forward ends of side portions 20 and may be made of a relatively stiff plastic material. Side tabs 21 are not joined to counter 7 or quarter 9, and include one or more eyelets 23. Loop 27 extends upwardly from heel tab 25, with the inner portion of the loop secured to the rear portion of sleeve 11. Loop 27 facilitates easy entry and exit of the wearer's foot from the shoe.

Figure 2D:
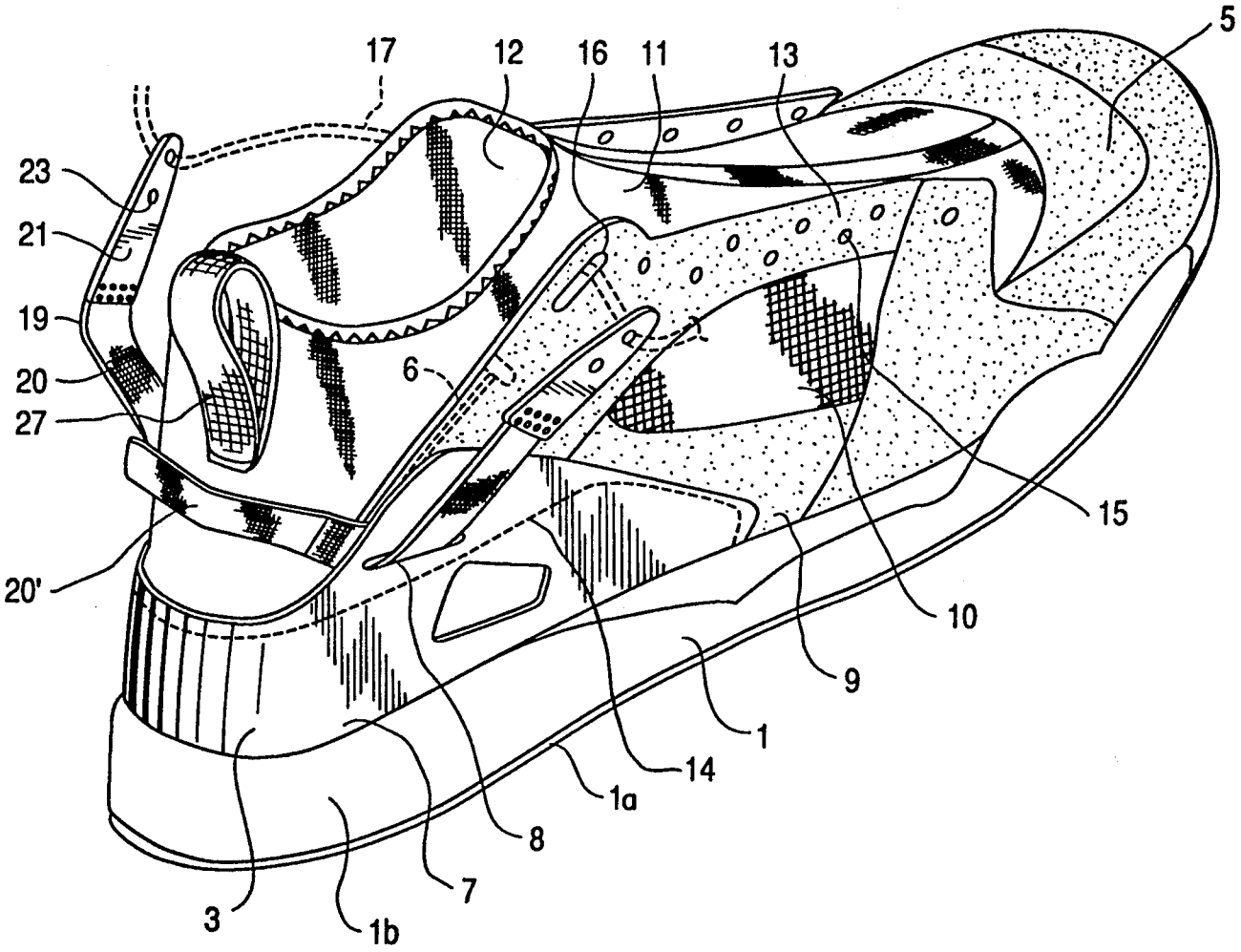
FIG. 2*d* shows a rear perspective view of an athletic shoe according to a fourth embodiment of the present invention.

Side portions 20 are disposed forwardly downwardly from heel tab 25 about both sides of sleeve 11, and through openings 8 through both sides of counter 7 from the interior sides thereof. Side portions 20 are bent upwardly exteriorly of counter 7 and thereby assume a V-shape, extending adjacent quarter 9. Side tabs 21 are disposed adjacent the upper portion of quarter 9 such that eyelets 23 overlap elongated eyelets 16. Accordingly, shoe lace 17 may be disposed through eyelets 23 of heel strap 19 after emerging from elongated eyelets 16. When shoe lace 17 is tied, side tabs 21 are pulled forwardly and secured against quarter 9, thus adjustably securing the remainder of heel strap 19 against the foot as described in more detail below. As shown in FIG. 2*d*, heel tab 25 could be eliminated, with the side portions comprising a single integral portion 20′ extending continuously about the posterior aspect of the wearer's foot. Portion 20′ could have side tabs 21 disposed at each terminal end which function as explained above. Alternatively, other conventional securing devices could be used in place of or in association with side tabs 21 to secure the ends of the strap adjacent the upper.

Figure 3:
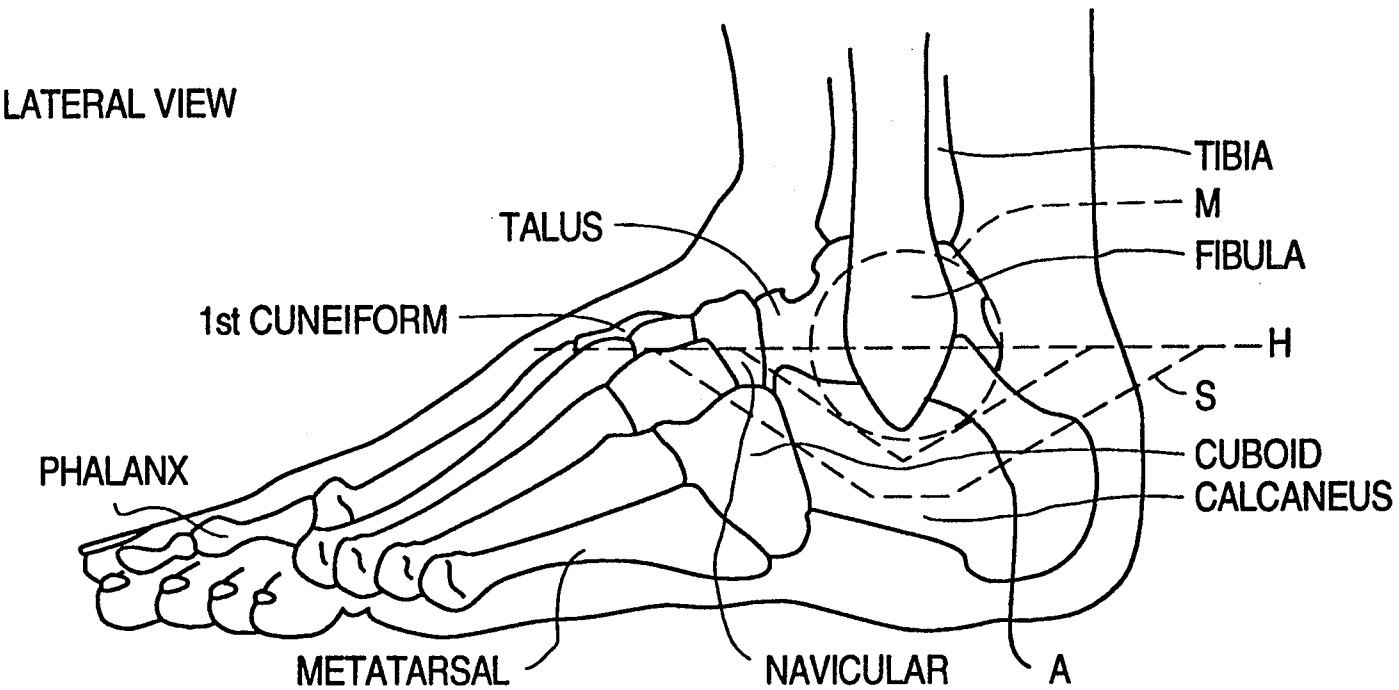
FIG. 3 shoes a lateral view of a human foot with the approximate location of a heel strap relative to the foot, according to the present invention.

With reference to FIG. 3, the approximate location of heel strap 19 relative to the bones of the foot is shown. As shown by the dotted lines labelled "S", the portion of heel strap 19 disposed from opening 8 forward overlaps the portion of heel strap 19 disposed from opening 8 rearward, so as to create an overall V-shape. The bottom of the V is flat and is generally defined by opening 8. Preferably, the strap makes an interior angle of approximately 30° with a horizontal plane "H" extending through the foot and above the strap, both forward and rearward of opening 8, as shown by the dashed lines in FIG. 3. The general location of the lateral malleolus is defined by the circle labelled "M". Strap 19 will be disposed below, and extend both forward and rearward of the location of lateral malleolus "M" when the shoe is worn. The same relationship would be established between the strap and the medial malleolus. The strap substantially will not overlap the malleoli, but does wrap about the medial and lateral aspects of the calcaneus or heel bone. However, strap 19 extends about the posterior of the wearer's heel in an area substantially above the calcaneus, or at least the superior aspect of the rearmost portion of the calcaneus.

Accordingly, due to the V-shape assumed by the heel strap of the present invention, the back of the heel experiences a pull which is both downward and forward, towards the location of opening 8, which is located below the malleolus. Thus, the heel of the foot is firmly secured in relation to the shoe, and in particular, the rearfoot is firmly seated in the midsole, resulting in a more stable shoe. In addition, the forward portion of the strap is wrapped about the medial and lateral aspects of the dorsal side of the midfoot, further securing the rearfoot and midfoot areas and thereby enhancing fit and stability.

In addition, heel tab 25 may be eliminated as in FIG. 2*d*, or may be completely independent of both counter 7 and sleeve 11 as in FIG. 2*c*. In the former case, strap 19 is free to conform directly to the shape of the individual heel in response to the pull on integral strap 20. In the latter case, heel tab 25 is free to conform directly to the shape of the individual heel, in response to the pull of side straps 20. In the embodiments of FIG. 2*b* in which heel tab 25 is only attached to sleeve 11 and is free from counter 7, and FIG. 2*a* in which heel tab 25 is attached to both counter 7 and sleeve 11, heel tab 25 still is substantially free to conform directly to the shape of the individual heel, in response to the pull of side straps 20. Both heel tab 25 and the portion of side straps 20 rearward of opening 8 are disposed essentially adjacent the foot, with only thin sleeve 11 disposed therebetween. In no case is heel tab 25 or the rear portion of straps 20 secured to the foot through a rigid intermediate member, for example, a stiff counter or thick upper portion which is relatively immobile. Thus, side straps 20 are also free to conform directly to the individual heel. Therefore, the securing effect provided by heel strap 19 on the foot is not diminished by a thick or rigid intermediate member, and heel strap 19 freely conforms to the heel of an individual user to firmly secure the foot to the footbed or midsole, providing maximum stability.

Furthermore, the axis of motion of the ankle is generally denoted as "A", and extends perpendicular to FIG. 3. Plantar flexion and dorsi flexion, that is, the pivoting motion of the foot where the foot can be pointed downwardly and upwardly, respectively, occur about this axis. Since strap 19 is disposed substantially beneath the malleoli and does not substantially restrict the range of motion about axis "A", strap 19 does not interfere with plantar or dorsi flexion.

We claim:

1. A shoe comprising:

a sole;

an upper extending from said sole, said upper having an opening on each side, said openings located so as to be positioned below the malleoli when the shoe is worn, said upper including a relatively thin, flexible inner sleeve, said sleeve receiving a wearer's foot;

a heel strap extending about a wearer's heel, said heel strap having forward ends, said heel strap disposed downwardly forwardly on both sides of the shoe towards and through said openings, and upwardly forwardly from the locations of said openings, said heel strap fixed to said inner sleeve at the heel and secured at its forward ends adjacent to said upper, said upper openings disposed at a lower height above the lower most surface of the shoe than the height at which said heel strap is fixed to said inner sleeve, at least a portion of said heel strap disposed substantially directly adjacent said sleeve and freely conforming to the shape of the wearer's heel through said sleeve.

2. The shoe recited in claim 1, said shoe comprising a shoe lace, said upper comprising a plurality of lacing eyelets, said heel strap having at least one eyelet disposed through each forward end, said eyelets of said heel strap disposed adjacent a corresponding lacing eyelet on each side of said shoe such that each end of the lace of said shoe may be disposed through one of said heel strap eyelets and a corresponding lacing eyelet.

3. The shoe recited in claim 1, said heel strap comprising a heel tab and two side portions, said heel tab fixed to said said inner sleeve at the heel, said side portions fixed to opposite sides of said heel tab.

4. The shoe recited in claim 1, said heel strap extending downwardly towards said upper openings so as to make an inner angle of approximately 30° with a horizontal plane extending through said upper above said heel strap.

5. The shoe recited in claim 1, said heel strap disposed to avoid interfering with dorsi flexion and plantar flexion of the foot.

6. A shoe comprising:

a sole;

an upper fixed to and disposed above said sole, said upper comprising a relatively flexible inner sleeve and an outer portion, said outer portion including a counter disposed about the rear of said shoe and extending forwardly on either side of said shoe, said counter having an opening disposed therethrough on each side, said outer portion comprising a plurality of lacing eyelets;

a heel strap disposed about a rear portion of said inner sleeve and extending laterally forwardly on both sides of said inner sleeve and terminating at a forward location on each side proximate one of said lacing eyelets, said heel strap having at least one eyelet at each forward location disposed adjacent a corresponding eyelet of said upper, said heel strap disposed through said opening through each side of said counter; wherein, on each side of said shoe, said shoe may be laced through one of said heel strap eyelets and a corresponding lacing eyelet.

7. The shoe recited in claim 6, said counter openings located so as to be positioned below the malleolus when the shoe is worn.

8. The shoe recited in claim 6, said heel strap disposed to avoid interfering with dorsi flexion and plantar flexion of the foot.

9. The shoe recited in claim 6, said heel strap fixedly attached to said rear portion of said inner sleeve.

10. The shoe recited in claim 6, said heel strap comprising a heel tab, said heel tab fixedly attached to said inner sleeve at a location adjacent the upper border of said heel tab.

11. The shoe recited in claim 10, said heel tab fixedly attached to said counter at a location adjacent the lower border of said heel tab.

12. A shoe comprising:

a sole;

an upper extending from said sole, said upper having an opening on each side, said openings located so as to be positioned below the malleoli when the shoe is worn, said upper including a relatively thin, flexible inner sleeve and a relatively stiff counter, said inner sleeve disposed interiorly of said counter and extending above said counter, said inner sleeve receiving a wearer's foot;

a heel strap extending about a wearer's heel, said heel strap having forward ends, said heel strap disposed downwardly forwardly on both sides of the shoe towards and through said openings, and upwardly forwardly from the locations of said openings, said heel strap secured at its forward ends adjacent to said upper, at least a portion of said heel strap disposed substantially directly adjacent said sleeve and freely conforming to the shape of the wearer's heel through said sleeve, said heel strap further comprising a heel tab disposed adjacent said inner sleeve above said counter.

13. The shoe recited in claim 12, said heel tab free standing from both said inner sleeve and said counter.

14. The shoe recited in claim 12, said heel tab secured to said inner sleeve and free-standing from said counter.

15. The shoe recited in claim 12, said heel tab secured adjacent an upper end thereof to said inner sleeve, said heel tab secured adjacent a lower end thereof to said counter, said heel tab substantially free of both said counter and said sleeve therebetween.

16. The shoe recited in claim 12, said counter disposed about the periphery of the rear of said shoe.

* * * * *